US011427362B2

(12) United States Patent
Liang et al.

(10) Patent No.: US 11,427,362 B2
(45) Date of Patent: Aug. 30, 2022

(54) VACUUM PACKAGING MACHINE

(71) Applicant: GUANGZHOU ARGION ELECTRIC APPLIANCE CO., LTD., Guangzhou (CN)

(72) Inventors: Guoqiang Liang, Guangzhou (CN); Linhua Pan, Guangzhou (CN); Yuanchao Wu, Guangzhou (CN); Zhicun Yin, Guangzhou (CN)

(73) Assignee: GUANGZHOU ARGION ELECTRIC APPLIANCE CO., LTD., Guangzhou (CN)

( * ) Notice: Subject to any disclaimer, the term of this patent is extended or adjusted under 35 U.S.C. 154(b) by 171 days.

(21) Appl. No.: 16/645,461

(22) PCT Filed: Aug. 23, 2018

(86) PCT No.: PCT/CN2018/101953
§ 371 (c)(1),
(2) Date: Mar. 7, 2020

(87) PCT Pub. No.: WO2019/047722
PCT Pub. Date: Mar. 14, 2019

(65) Prior Publication Data

US 2020/0283178 A1 Sep. 10, 2020

(30) Foreign Application Priority Data

Sep. 7, 2017 (CN) ..... 201710803140.6

(51) Int. Cl.
*B65B 51/10* (2006.01)
*B65B 31/02* (2006.01)

(52) U.S. Cl.
CPC ..... *B65B 31/024* (2013.01); *B65B 51/10* (2013.01)

(58) Field of Classification Search
CPC ..... B65B 31/00; B65B 31/02; B65B 31/024; B65B 31/04; B65B 31/06; B65B 51/10; B65B 51/146; B65B 57/005
USPC ..... 53/86, 79, 477, 510, 432, 403, 405, 408
See application file for complete search history.

(56) References Cited

U.S. PATENT DOCUMENTS 5,673,541 A * 10/1997 Arzuman ..... B65B 43/465 53/284.7
2003/0159405 A1* 8/2003 Knowlton ..... B29C 66/8221 53/434
2008/0302253 A1* 12/2008 Salvaro ..... F24C 15/00 99/325

FOREIGN PATENT DOCUMENTS

| | | | |
|---|---|---|---|
| CN | 200957889 | Y | 10/2007 |
| CN | 201545215 | U | 8/2010 |
| CN | 201647148 | U | 11/2010 |
| CN | 204433132 | U | 7/2015 |
| CN | 107521748 | A | 12/2017 |
| EP | 2000741 | A2 | 12/2008 |
| EP | 2208677 | A1 | 7/2010 |
| JP | 3325916 | B2 | 9/2002 |

* cited by examiner

*Primary Examiner* — Chelsea E Stinson
*Assistant Examiner* — Mary C Hibbert-Copeland

(57) ABSTRACT

Provided is a novel vacuum packaging machine, comprising a machine body (1), a vacuum cover (2) and a bag hanging mechanism (3), wherein a vacuum chamber (11) enabling a packaging bag (4) to be vertically placed is provided in the machine body (1), the vacuum cover (2) is provided on the machine body (1) and corresponds to the vacuum chamber (11), and the bag hanging mechanism (3) is provided at the upper part of the vacuum chamber (11).

8 Claims, 4 Drawing Sheets

VACUUM PACKAGING MACHINE

CROSS REFERENCE TO RELATED APPLICATIONS

This application is the national phase entry of International Application PCT/CN2018/101953, filed on Aug. 23, 2018, which is based upon and claims priority to Chinese Patent Application No. 201710803140.6, filed on Sep. 7, 2017, the entire contents of which are incorporated herein by reference.

TECHNICAL FIELD

The invention relates to the technical field of packaging equipment and kitchen equipment (low-temperature and vacuum cooking), and in particular to a novel vacuum packaging machine.

BACKGROUND

As shown in FIG. 1, a vacuum chamber 10 of a common (chamber) vacuum packaging machine is generally designed to be horizontal. However, vacuum chambers 10 of some (chamber) vacuum machines are designed to be at a certain inclined angle. Accordingly, when a packaging bag is vacuumized and heat-sealed, it is placed in the vacuum chamber 10 horizontally or at an inclined angle.

For such (chamber) vacuum packaging machines, in order to ensure that the packaging bag achieves a good heat-sealing effect, the bag mouth of the packaging bag must be kept flat. However, when the packaging bag contains irregularly shaped food (objects) and the food (objects) are placed horizontally or at an inclined angle, it is difficult to effectively ensure the flatness of the bag mouth. Especially when the packaging bag contains too many objects, these objects will cause the bag mouth to be irregular or wrinkle seriously, which will affect the heat-sealing effect and cause air leakage. When the packaging bag contains liquid, dust, or granular objects, the bag mouth of the packaging bag is difficult to be stabilized on a heater flatly due to fluidity of these objects, and it is more difficult to ensure a good heat-sealing effect at this time. In addition, these objects have fluidity which is limited by placement status, i.e., placed horizontally or at a certain inclined angle, in order to prevent contents from leaking out from the bag mouth of the packaging bag, the amount of liquid, dust or granular objects in the packaging bag is greatly limited. That is, since the vacuum chamber 10 of the existing (chamber) vacuum machine is designed to be horizontal or at a certain inclined angle, there will be two problems: one is that it is difficult to keep the bag mouth of the packaging bag flat, and the vacuum packaging machine does not achieve an ideal heat-sealing effect of the packaging bag; and the other is that the vacuum packaging machine cannot seal a packaging bag containing a large amount of fluid objects such as liquid, dust or granular objects.

SUMMARY

In order to overcome the technical problem that the existing vacuum packaging machine cannot seal a packaging bag containing a large number of fluid objects, the invention provides a novel vacuum packaging machine capable of sealing a packaging bag containing a large number of fluid objects.

In order to achieve the aforementioned objective, the invention provides a novel vacuum packaging machine suitable for sealing a packaging bag, wherein the novel vacuum packaging machine comprises a machine body, a vacuum cover and a bag hanging assembly. A vacuum chamber enabling a packaging bag (4) to be vertically placed is provided in the machine body. The vacuum cover is provided on the machine body and corresponds to the vacuum chamber. The bag hanging assembly is provided at the upper part of the vacuum chamber.

In the aforementioned novel vacuum packaging machine, the bag hanging assembly comprises a hanging part and a bag hanging part;

the hanging part is provided at the upper part of the vacuum chamber, and the bag hanging part is installed on the hanging part; and the bag hanging part comprises at least two bag hanging units, and one or more of the at least two bag-hanging units are slidable relative to the hanging part.

In the aforementioned novel vacuum packaging machine, the hanging part comprises a guide rail which is fixed at the upper part of the vacuum chamber; the bag hanging part comprises two bag hanging units denoted as a first bag hanging unit and a second bag hanging unit respectively; the first bag hanging unit is fixedly installed on the guide rail; and the second bag hanging unit is installed on the guide rail and can reciprocate away from and close to the first bag hanging unit relative to the guide rail.

In the aforementioned novel vacuum packaging machine, the first bag hanging unit comprises a first hook fixedly installed on the guide rail; the second bag hanging unit comprises a sliding member and a second hook provided on the sliding member for vertically hanging a packaging bag; and the sliding member is installed on the guide rail and can drive the second hook to reciprocate away from and close to the first hook on the guide rail.

In the aforementioned novel vacuum packaging machine, the sliding member is a sliding block, an upper surface of the guide rail is provided with sawteeth, and a side of the sliding block opposite to the sawteeth on the guide rail is provided with an elastic piece; and the elastic piece is meshed with the sawteeth on the guide rail so that the sliding block moves in a straight reciprocating motion.

In the aforementioned novel vacuum packaging machine, the novel vacuum packaging machine further comprises a heat-sealing assembly, the heat-sealing assembly comprises a heating part and a heat-sealing strip; the heating part is provided in the vacuum chamber, and the heat-sealing strip is provided on an inner side wall of the vacuum cover and corresponds to the heating part.

In the aforementioned novel vacuum packaging machine, the novel vacuum packaging machine further comprises a horizontal telescoping part installed on the machine body; a telescoping end of the horizontal telescoping part is provided with the heating part and can drive the heating part to reciprocate away from and close to the heat-sealing strip.

In the aforementioned novel vacuum packaging machine, the heating part comprises a heater and a position-limiting member; the telescoping end of the telescoping part is provided with a fixing block for installing the heater;

the position-limiting member is installed between the heater and the fixing block, so that the heater and the position-limiting member are stationary relative to each other during a heat-sealing process.

In the aforementioned novel vacuum packaging machine, the novel vacuum packaging machine further comprises a vacuumizing assembly comprising a vacuum pump and an exhaust port provided on the machine body; the exhaust port communicates with the vacuum chamber, and the suction port of the vacuum pump communicates with the exhaust port.

In the aforementioned novel vacuum packaging machine, the novel vacuum packaging machine further comprises a control unit provided on the machine body.

The invention has the following beneficial effects in comparison with the prior art:

Since the vacuum chamber enabling the packaging bag to be placed vertically is provided in the machine body along the height direction of the machine body, and the bag hanging assembly is provided at the upper part of the vacuum chamber, when the packaging bag is sealed by the vacuum packaging machine of the invention, the packaging bag is placed vertically, and the bag mouth of the packaging bag is located at the upper part of the vacuum chamber through the bag hanging assembly, so that when the product contained in the packaging bag is a fluid object, there is no need to worry about the fluid object leaking out from the bag mouth. Therefore, the vacuum packaging machine of the invention can seal a packaging bag containing a larger amount of fluid objects than vacuum packaging machines in the prior art;

In addition, the novel vacuum packaging machine of the invention can make it easier for the packaging bag to keep the bag mouth flat when the packaging bag contains irregular or large-sized objects, and thus it is easier to obtain a good heat-sealing effect.

Figure 1:
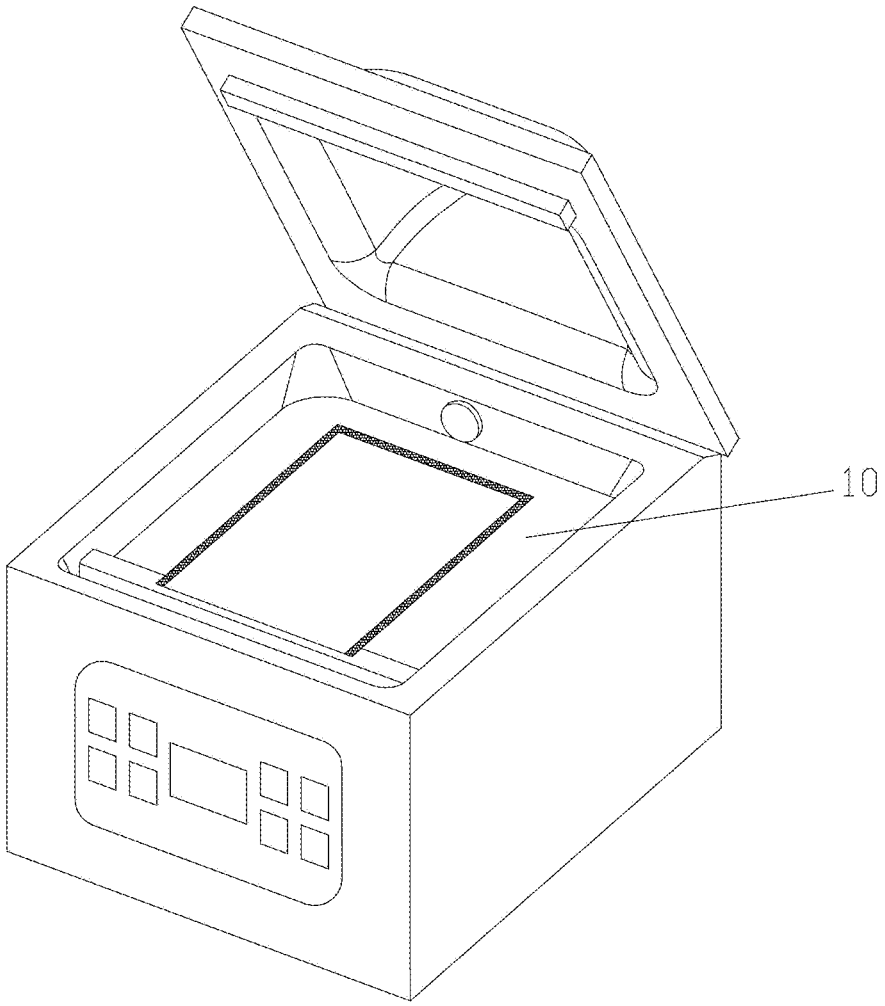
FIG. 1 is a schematic diagram of a vacuum packaging machine in the prior art.

In the Figures: 100, a novel vacuum packaging machine; 1, machine body; 11, a vacuum chamber; 2, a vacuum cover; 3, a bag hanging assembly; 31, a hanging part; 311, a guide rail; 3111, sawteeth; 32, a bag hanging part; 321, a first bag hanging unit; 3211, a first hook; 322, a second bag hanging unit; 3221, a second hook; 3222, a sliding member; 3223, an elastic piece; 4, a packaging bag; 5, a heat-sealing assembly; 51, a heat-sealing strip; 52, a heating part; 521, a heater; 522, a position-limiting member; 6, a horizontal telescoping part; 61, a telescoping end; 62, a fixing block; 7, a vacuumizing assembly; 71, a vacuum pump; 72, an exhaust port; 8, a control unit; and 10, a vacuum chamber.

DETAILED DESCRIPTION OF THE EMBODIMENTS

The specific embodiments of the invention will be further described in detail below with reference to the accompanying drawings and embodiments. The following embodiments are used to illustrate the invention, but not to limit the scope of the invention.

Refer to FIGS. 2 to 5. A novel vacuum packaging machine provided in the invention is suitable for sealing a packaging bag 4, which comprises a machine body 1, a vacuum cover 2 and a bag hanging assembly 3. A vacuum chamber 11 enabling the packaging bag 4 to be vertically placed is provided in the machine body 1. The vacuum cover 2 is provided on the machine body 1 and corresponds to the vacuum chamber 11, and the bag hanging assembly 3 is provided at the upper part of the vacuum chamber 11.

Since the vacuum chamber 11 enabling the packaging bag 4 to be placed vertically is provided in the machine body 1 along the height direction of the machine body 1, and the bag hanging assembly 3 is provided at the upper part of the vacuum chamber 11, when the packaging bag 4 is sealed by the vacuum packaging machine of the invention, the packaging bag 4 is placed vertically, and the bag mouth of the packaging bag 4 is located at the upper part of the vacuum chamber 11 through the bag hanging assembly 3, so that when the product contained in the packaging bag 4 is a fluid object, there is no need to worry about the fluid object leaking out from the bag mouth. Therefore, the vacuum packaging machine of the invention can seal a packaging bag 4 containing a larger amount of fluid objects than vacuum packaging machines in the prior art.

In addition, the novel vacuum packaging machine 100 of the invention can make it easier for the packaging bag 4 to keep the bag mouth flat when the packaging bag contains irregular or large-sized objects, and thus it is easier to obtain a good heat-sealing effect.

Figure 2:
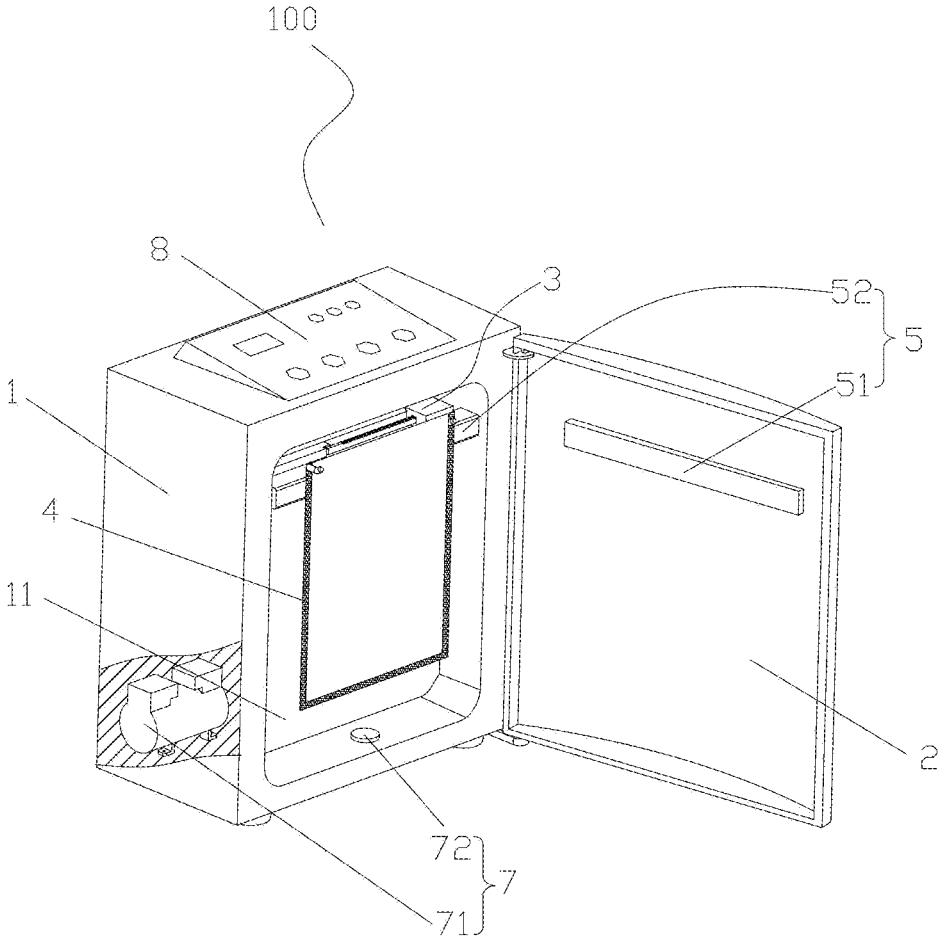
FIG. 2 is a schematic structural diagram of a novel vacuum packaging machine according to an embodiment of the invention.
Figure 3:
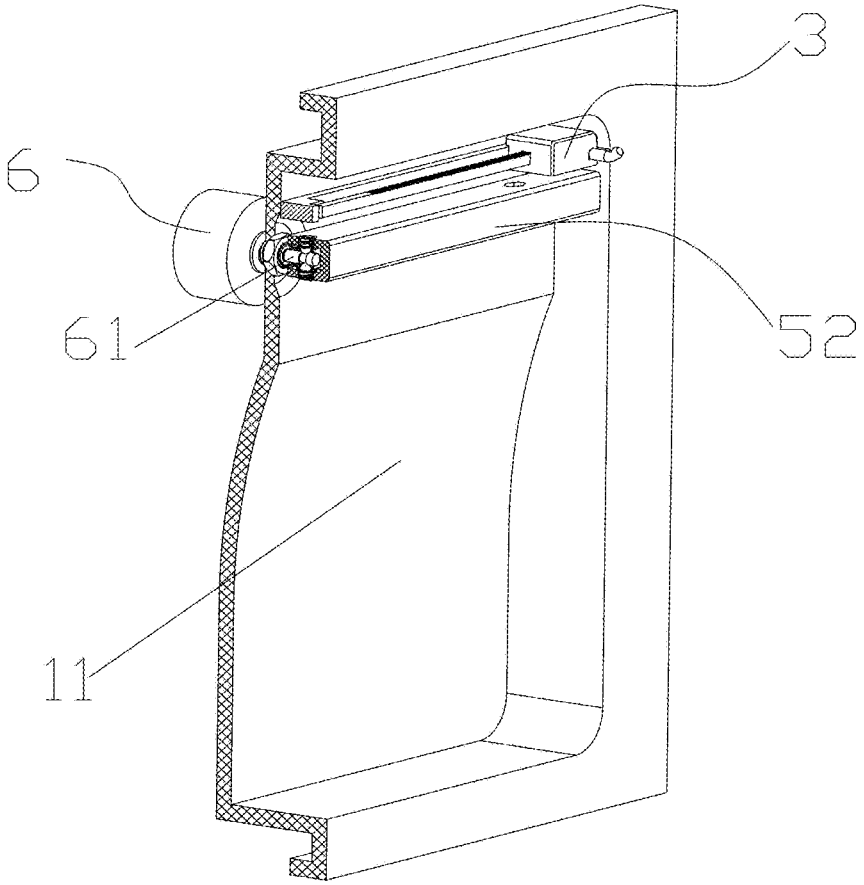
FIG. 3 is a partial cross-sectional view of a novel vacuum packaging machine according to an embodiment of the invention.
Figure 5:
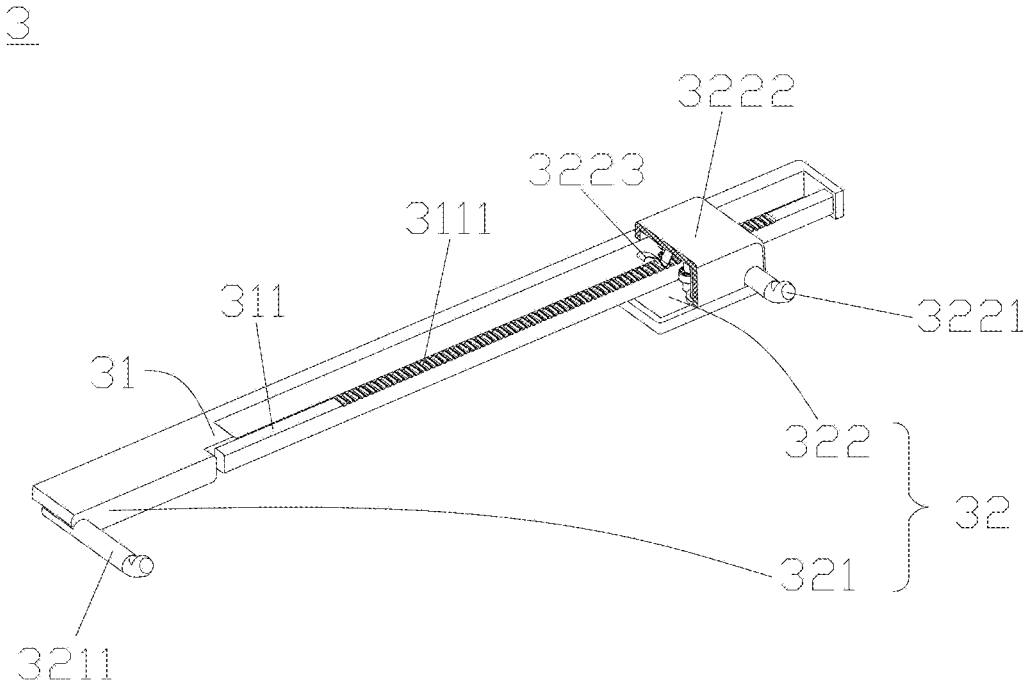
FIG. 5 is a schematic structural diagram of a bag hanging assembly of a novel vacuum packaging machine according to an embodiment of the invention.

Refer to FIGS. 2, 3, and 5. Preferably, the bag hanging assembly 3 comprises a hanging part 31 and a bag hanging part 32. The hanging part is provided at the upper part of the vacuum chamber 11, and the bag hanging part 32 is installed on the hanging part 31.

The bag hanging part 32 comprises at least two bag hanging units, and one or more of the at least two bag-hanging units are slidable relative to the hanging part 31. In this way, on the one hand, the vacuum packaging machine according to the embodiment of the invention can adapt to packaging bags 4 with different widths. On the other hand, the packaging bag 4 (and its contents) will extend vertically under the action of its own gravity. Moreover, since one or more of the at least two bag hanging units are slidable relative to the hanging part 31, the bag mouth of the packaging bag 4 can be kept flat horizontally by adjusting the slidable bag hanging units, thereby improving the heat-sealing effect.

Obviously, if the packaging bag 4 to be sealed by the novel vacuum packaging machine 100 according to the embodiment of the invention has a constant width, the bag hanging units included in the bag hanging part 32 may also be stationary relative to the hanging part 31.

Refer to FIGS. 2, 3, and 5. Preferably, the hanging part 31 comprises a guide rail 311 which is fixed at the upper part of the vacuum chamber 11; the bag hanging part 32 comprises two bag hanging units denoted as a first bag hanging unit 321 and a second bag hanging unit 322; the first bag hanging unit 321 is fixedly installed on the guide rail 311; and the second bag hanging unit 322 is installed on the guide rail 311 and can reciprocate away from and close to the first bag hanging unit 321 relative to the guide rail. In this way, on the one hand, the bag hanging assembly 3 can have a simple structure, simplified operation, and improved convenience of use; on the other hand, the cost of the vacuum packaging machine can be reduced.

Refer to FIGS. 2, 3, and 5. Preferably, the first bag hanging unit 321 comprises a first hook 3211 fixedly installed on the guide rail 311; the second bag hanging unit 322 comprises a sliding member 3222 and a second hook 3221 provided on the sliding member 3222 for vertically hanging a packaging bag 4; and the sliding member 3222 is installed on the guide rail 311 and can drive the second hook 3221 to reciprocate away from and close to the first hook 3211 on the guide rail 311. Therefore, this can make the vacuum packaging machine according to the embodiment of the invention simple and convenient to be operated during use.

Obviously, according to different needs of design and/or use, the bag hanging unit not only hangs the packaging bag 4 vertically through hooks, but also the bag hanging unit hangs the packaging bag 4 vertically in other ways, for example, the bag hanging unit hangs the packaging bag 4 vertically in a way of clamping or adsorption through clips, suction cups and the like. Alternatively, the bag hanging unit hangs or adhere the packaging bag 4 vertically through other parts.

Refer to FIGS. 2, 3, and 5. Preferably, the sliding member 3222 is a sliding block, an upper surface of the guide rail 311 is provided with sawteeth 3111, and a side of the sliding block opposite to the sawteeth 3111 on the guide rail 311 is provided with an elastic piece 3223; and the elastic piece 3223 is meshed with the sawteeth 3111 on the guide rail 311 so that the sliding block 3222 moves in a straight reciprocating motion. In this way, on the one hand, while ensuring that the bag hanging assembly 3 has features of a simple structure, simplified operation, and improved convenience of use, the bag hanging assembly 3 can adapt to packaging bags 4 with different widths; on the other hand, the elastic piece 3223 meshes with the sawteeth 3111 so that the interval between the first hook 3211 and the second hook 3221 can be adjusted to be suitable for the packaging bag 4, and until the second hook 3221 is stationary relative to the first hook 3211, thereby ensuring that the bag mouth of the packaging bag 4 is kept flat in the horizontal direction to the greatest extent to improve the heat-sealing effect.

Refer to FIGS. 2 and 3. The novel vacuum packaging machine 100 according to the embodiment of the invention further comprises a heat-sealing assembly 5. The heat-sealing assembly 5 comprises a heating part 52 and a heat-sealing strip 51; the heating part 52 is provided in the vacuum chamber 11, and the heat-sealing strip 51 is provided on an inner side wall of the vacuum cover 2 and corresponds to the heating part 52, so that the heat-sealing assembly 5 has a better heat-sealing effect of the bag mouth of the packaging bag 4.

Figure 4:
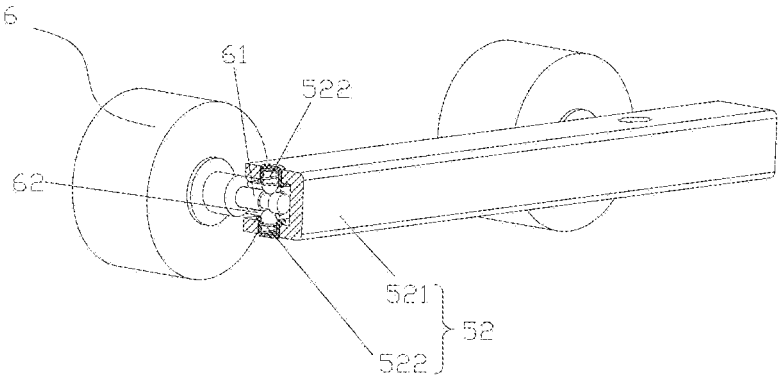
FIG. 4 is a schematic diagram of a heater and a horizontal telescoping part of a novel vacuum packaging machine according to an embodiment of the invention.

Refer to FIGS. 2, 3, and 4. In order to maximize the heal-sealing effect of the heat-sealing assembly 5 on the bag mouth of the packaging bag 4, preferably, the novel vacuum packaging machine 100 according to the embodiment of the invention further comprises a horizontal telescoping part 6 installed on the machine body 1; a telescoping end 61 of the horizontal telescoping part 6 is provided with the heating part 52 and can drive the heating part 52 to reciprocate away from and close to the heat-sealing strip 51. When the vacuumizing operation is completed, the horizontal telescoping part 6 can drive the heating unit 52 to move to the heat-sealing strip 51 by a certain distance, so that the packaging bag 4 located between the heating unit 52 and the heat-sealing strip 51 is squeezed tighter.

Refer to FIGS. 2, 3, and 4. The heating part 52 comprises a heater 521 which is provided in the vacuum chamber 11 and below the guide rail 311. The telescoping end 61 of the telescoping part 6 is provided with a fixing block 62 for installing the heater 521.

When the horizontal telescoping part 6 drives the heater 521 to move to the heat-sealing strip 51, the heater 521 may swing up and down in the vertical direction under the action of its own gravity, which will cause position offset of the heater 521 and the packaging bag 4, affecting the heat-sealing effect.

Accordingly, refer to FIGS. 3 and 4, preferably, the heating part 52 further comprises a position-limiting member 522 installed between the heater 521 and the fixing block 62, so that the heater 521 and the position-limiting member 522 are stationary relative to each other during a heat-sealing process.

Refer to FIG. 2. The novel vacuum packaging machine 100 according to the embodiment of the invention further comprises a vacuumizing assembly 7 comprising a vacuum pump 71, and an exhaust port 72 provided on the machine body 1. The exhaust port 72 communicates with the vacuum chamber 11, and the suction port of the vacuum pump 71 communicates with the exhaust port 72.

Refer to FIG. 2. The novel vacuum packaging machine 100 according to the embodiment of the invention further comprises a control unit 8 provided on the machine body 1. Preferably, the control unit 8 is provided on an upper side of the machine body, which is convenient to operate. Obviously, according to different designs and operating requirements, the control unit 8 may also be provided at a side of the machine body 1 or below the machine body 1.

In conclusion, the novel vacuum packaging machine 100 according to the embodiment of the invention has the following beneficial effects in comparison with the prior art:

Since the vacuum chamber 11 enabling the packaging bag 4 to be placed vertically is provided in the machine body 1 along the height direction of the machine body 1, and the bag hanging assembly 3 is provided at the upper part of the vacuum chamber 11, when the packaging bag 4 is sealed by the vacuum packaging machine of the invention, the packaging bag 4 is placed vertically, and the bag mouth of the packaging bag 4 is located at the upper part of the vacuum chamber 11 through the bag hanging assembly 3, so that when the product contained in the packaging bag 4 is a fluid object, there is no need to worry about the fluid object leaking out from the bag mouth. Therefore, the vacuum packaging machine of the invention can seal a packaging bag 4 containing a larger amount of fluid objects than vacuum packaging machines in the prior art.

In addition, the novel vacuum packaging machine 100 of the invention can make it easier for the packaging bag 4 to keep the bag mouth flat when the packaging bag contains irregular or large-sized objects, and thus it is easier to obtain a good heat-sealing effect.

It should be understood that the terms "first", "second", and the like are used in the invention to describe various kinds of information, but the information should not be limited to these terms, these terms are only used to distinguish the same type of information from each other. For example, without departing from the scope of the invention, "first" information may also be referred to as "second" information, and similarly, the "second" information may also be referred to as the "first" information.

The above are only the preferred embodiments of the invention. It should be noted that, several improvements and replacements can be made by those skilled in the art without departing from the technical principles of the invention. These improvements and replacements also fall into the protection scope of the invention.

What is claimed is:

1. A novel vacuum packaging machine suitable for sealing a packaging bag, wherein the novel vacuum packaging machine comprises a machine body, a vacuum cover and a bag hanging assembly; a vacuum chamber enabling a packaging bag to be vertically placed is provided in the machine body, the vacuum cover is provided on the machine body and corresponds to the vacuum chamber, and the bag hanging assembly is provided at the upper part of the vacuum chamber;

wherein the bag hanging assembly comprises a hanging part and a bag hanging part; the hanging part is provided at the upper part of the vacuum chamber, and the bag hanging part is installed on the hanging part; the bag hanging part comprises at least two bag hanging units, and one or more of the at least two bag-hanging units are slidable relative to the hanging part;

wherein the hanging part comprises a guide rail which is fixed at the upper part of the vacuum chamber; the bag hanging part comprises two bag hanging units denoted as a first bag hanging unit and a second bag hanging unit respectively; the first bag hanging unit is fixedly installed on the guide rail; and the second bag hanging unit is installed on the guide rail and can reciprocate away from and close to the first bag hanging unit-relative to the guide rail;

wherein the first bag hanging unit comprises a first hook fixedly installed on the guide rail; the second bag hanging unit comprises a sliding member and a second hook provided on the sliding member for vertically hanging a packaging bag; and the sliding member is installed on the guide rail and can drive the second hook to reciprocate away from and close to the first hook on the guide rail;

wherein the sliding member is a sliding block, an upper surface of the guide rail is provided with sawteeth, and a side of the sliding block opposite to the sawteeth on the guide rail is provided with an elastic piece; and the elastic piece is meshed with the sawteeth on the guide rail-so that the sliding block moves in a straight reciprocating motion.

2. The novel vacuum packaging machine according to claim 1, wherein the novel vacuum packaging machine further comprises a heat-sealing assembly, the heat-sealing assembly comprises a heating part and a heat-sealing strip; the heating part is provided in the vacuum chamber, and the heat-sealing strip is provided on an inner side wall of the vacuum cover and corresponds to the heating part.

3. The novel vacuum packaging machine according to claim 2, wherein the novel vacuum packaging machine further comprises a horizontal telescoping part installed on the machine body; a telescoping end of the horizontal telescoping part is provided with the heating part and can drive the heating part to reciprocate away from and close to the heat-sealing strip.

4. The novel vacuum packaging machine according to claim 3, wherein the heating part comprises a heater and a position-limiting member; the telescoping end of the telescoping part is provided with a fixing block for installing the heater;

the position-limiting member is installed between the heater and the fixing block, so that the heater and the position-limiting member are stationary relative to each other during a heat-sealing process.

5. The novel vacuum packaging machine according to claim 2, wherein the novel vacuum packaging machine further comprises a vacuumizing assembly comprising a vacuum pump and an exhaust port provided on the machine body; the exhaust port communicates with the vacuum chamber, and the suction port of the vacuum pump communicates with the exhaust port.

6. The novel vacuum packaging machine according to claim 2, wherein the novel vacuum packaging machine further comprises a control unit provided on the machine body.

7. The novel vacuum packaging machine according to claim 1, wherein the novel vacuum packaging machine further comprises a vacuumizing assembly comprising a vacuum pump and an exhaust port provided on the machine body; the exhaust port communicates with the vacuum chamber, and the suction port of the vacuum pump communicates with the exhaust port.

8. The novel vacuum packaging machine according to claim 1, wherein the novel vacuum packaging machine further comprises a control unit provided on the machine body.

* * * * *